United States Patent [19]

Peterson

[11] 4,317,094

[45] Feb. 23, 1982

[54] REMOTELY CONTROLLED CIRCUIT BREAKER SYSTEM

[75] Inventor: Robert W. Peterson, North Attleboro, Mass.

[73] Assignee: Texas Instruments Incorporated, Dallas, Tex.

[21] Appl. No.: 151,857

[22] Filed: May 21, 1980

[51] Int. Cl.[3] ..... H01H 71/10

[52] U.S. Cl. ..... 335/13; 335/21; 335/140; 335/166

[58] Field of Search ..... 335/13, 21, 140, 166, 335/170, 174, 123, 20

[56] References Cited

U.S. PATENT DOCUMENTS

| | | | |
|---|---|---|---|
| 2,892,059 | 6/1959 | Keirans | 335/140 |
| 2,912,543 | 11/1959 | Hawkins | 335/140 |
| 3,361,882 | 1/1968 | Clarke | 200/116 |
| 3,593,235 | 7/1971 | Nicol | 335/186 |
| 3,651,436 | 3/1972 | Cooper et al. | 335/13 |

*Primary Examiner*—L. T. Hix
*Assistant Examiner*—Stafford D. Schreyer
*Attorney, Agent, or Firm*—James P. McAndrews; John A. Haug; Melvin Sharp

[57] ABSTRACT

A remotely controlled circuit breaker system incorporates a generally conventional circuit breaker having latch means which are moveable in a first direction for moving an operating member so that it is latched in closed circuit position, the operating member being adapted to be independently moveable in the same first direction for unlatching the member to permit the member to return to its open circuit position. A momentarily operable solenoid has a pawl pivotally mounted on the solenoid plunger. Spring means resiliently hold the pawl against a stop in a selected location relative to the latch means so that when the solenoid is momentarily actuated while the operating member is in open circuit position, the pawl engages the latch means and moves the operating member to its latched closed circuit position. However, if the operating member is in closed circuit position, actuation of the solenoid moves the pawl away from the stop and the spring means pivots and reorients the pawl so that it engages the operating member, thereby to unlatch the operating member for permitting it to return to open circuit position.

9 Claims, 6 Drawing Figures

REMOTELY CONTROLLED CIRCUIT BREAKER SYSTEM

BACKGROUND OF THE INVENTION

The field of this invention is that of remotely controlled circuit breaker systems and the invention relates more particularly to a low cost, reliable system for providing remote control for circuit breakers which are of generally conventional configurations.

There are a large number of situations, particularly in aircraft, where it is desirable to mount a circuit breaker in one location to be responsive to overload current conditions or the like in an electrical circuit for opening the circuit and where it is also desirable to be able to operate the circuit breaker as a contactor from a second, remote location. For example, in aircraft it is frequently desirable to avoid the weight and cost of running long lengths of heavy and expensive cable from power generators to electrical loads via the cockpit or flight engineers console. It is much easier and more economical to locate circuit breakers near the generators or loads for protecting the circuits against overload conditions and then to run light, inexpensive remote control wires to the breaker from a switch in a control console to permit remote, selective operation of the breaker as an electrical contactor as is shown in U.S. Pat. No. 3,651,436. Typically however, circuit breakers which have been adapted for such remote control operation have tended to be of special and expensive construction and there are many applications where it would be desirable to be able to employ remotely controlled circuit breaker systems incorporating more widely available and less expensive circuit breakers of conventional configurations such as shown in U.S. Pat. No. 3,361,882.

SUMMARY OF THE INVENTION

It is an object of this invention to provide a novel and improved remotely-controlled circuit breaker system; to provide such a system which is characterized by low cost and high reliability; and to provide such a system which is versatile and adapted to incorporate circuit breaker components of various different conventional configurations. It is a further object of this invention to provide such a remotely controlled circuit breaker system which is compact and rugged and which is adapted to be conveniently mounted in any selected location.

Briefly described, the novel and improved circuit breaker system includes any generally conventional circuit breaker unit having latch means which are adapted to be moved in a first direction, into the circuit breaker housing for example, for moving the operating member of the breaker from open to closed circuit position and for releasably latching the operating member in the closed circuit position. The circuit breaker used in the system also has the operating member arranged so that, when it is in its closed circuit position, a small independent movement of the member in the same direction unlatches the member and thereby permits the operating member to move back to its open circuit position. In accordance with this invention, the system further includes solenoid or the like which is adapted to be momentarily energized by closing of a switch at a location remote from the circuit breaker. The solenoid plunger has a pawl which is pivotely mounted on one end of the plunger and which is resiliently biased by a spring to pivot to a selected orientation on the plunger. However, the pawl is adapted to engage stop means when the plunger is in a rest position before the solenoid is energized, the engagement of the pawl with the stop serving to hold the pawl in a different orientation. The solenoid is mounted relative to the circuit breaker so that, when the solenoid is energized to move the solenoid plunger while the operating member of the circuit breaker is in its open circuit position, the plunger moves and promptly engages the pawl with the latch means to move the operating member to circuit closing position. However when the solenoid is energized while the operating member is in its closed circuit position, the initial movement of the plunger moves the pawl off the stop means and permits the pawl to reorient in response to the spring bias. Further movement of the solenoid plunger then engages the pawl with the operating member to move the operating member in the same, first direction which unlatches the operating member and permits it to return to its open circuit position. In that arrangement, simple, reliable, low-cost operation of the solenoid and pawl means is achieved from a location remote from the circuit breaker component. Operation of the system is prompt, forceful and reliable and the circuit breaker system is compact, is of any conventional type, and is therefore adapted to be manufactured at low cost for use in the system.

DESCRIPTION OF THE DRAWING

Other objects, advantages and details of the novel and improved remotely controlled circuit breaker system of this invention appear in the following detailed description of preferred embodiments of the invention, the detailed description referring to the drawings in which.

DESCRIPTION OF THE PREFERRED EMBODIMENT

Figure 3:
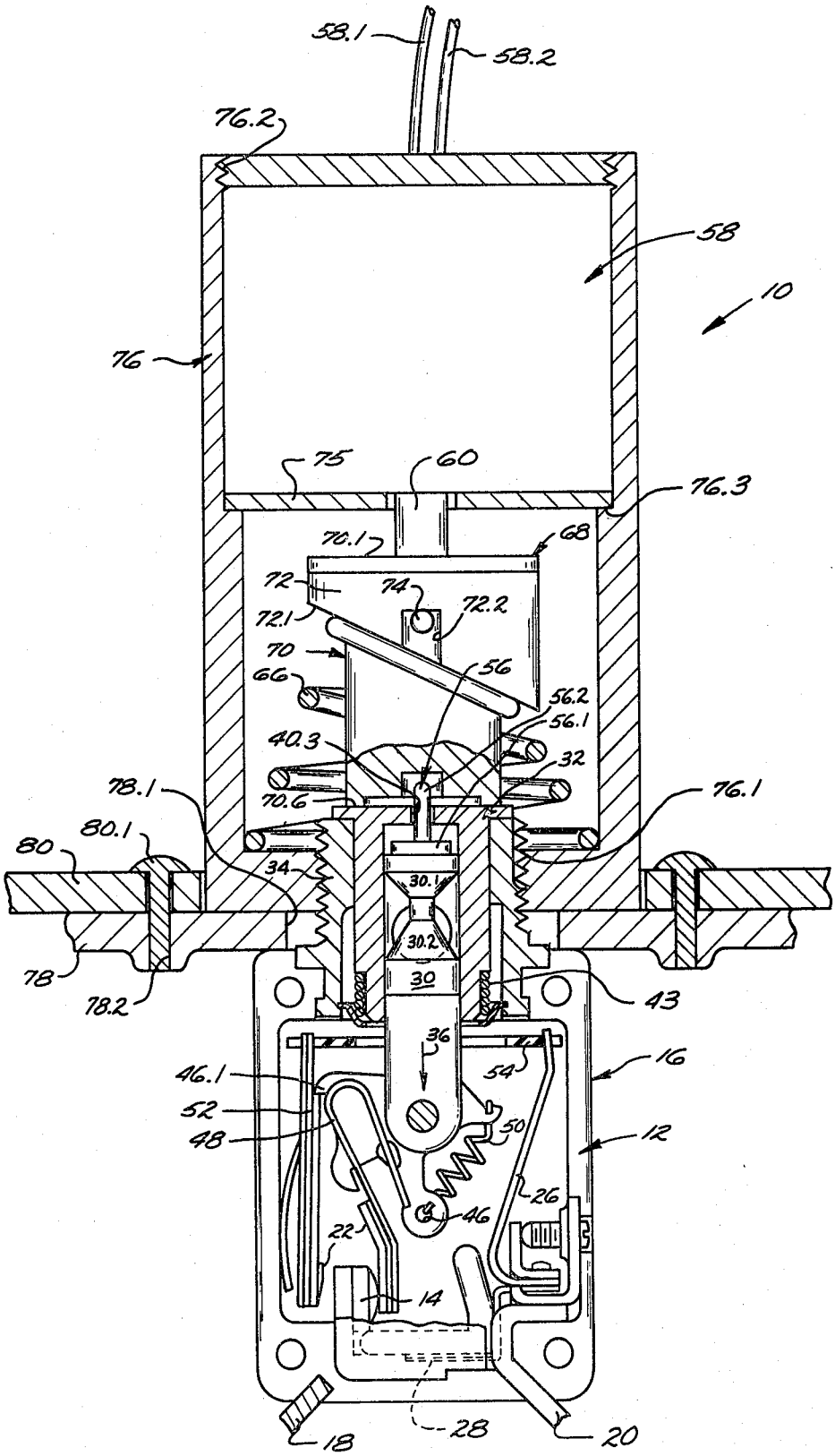
FIG. 3 is a section view similar to FIG. 1 illustrating the circuit breaker of the system being latched in closed circuit position.

Referring to the drawings, 10 in FIGS. 1–5 indicates the remotely controlled circuit breaker system of this invention which is shown to include a circuit breaker component 12 of a generally conventional configuration such as is shown in U.S. Pat. No. 3,361,882. As shown in that patent and in the drawings, the circuit breaker preferably includes a pair of fixed contacts 14 (only one of which is shown in the drawings) mounted on a housing means 16 and connected to respective terminals 18 and 20 so that a bridging contact member 22 is moveable from the open circuit position shown in FIG. 1 to the closed circuit position engaging and bridging the fixed contacts 14 as is shown in FIG. 3. One fixed contact 14 is connected to its respective terminal 20 through a strap 24 and through a thermally responsive bimetal 26 and a strap 28. The other fixed contact 14 is preferably connected directly to the terminal 18 as will be understood. Accordingly, the breaker circuit extends from the terminal 18 to the fixed contact 14 (not shown) through the bridging contact member 22 to the other fixed contact 14, to the strap 24, the thermally responsive bimetal 26, and the strap 28 to the opposite terminal 20. An operating member 30 is axially moveable with a latch means 32 inside an externally threaded breaker mounting bushing 34 in the direction indicated by the arrows 36 and 38. The latch means includes a latch bushing 40 having apertures 40.1 in opposite sides thereof and a pair of latching balls 42 which are disposed in the apertures. A coil spring 43 biasses the latch means 32 and the operating member 30 to move in the direction of the arrow 38 to the open circuit position shown in FIG. 1, and a cam surface 44 is formed on the interior of the mounting bushing 34. The operating member has conical cam surfaces 30.1 and 30.2 which are located inside the latch bushing 40 as shown in the drawings. The latch bushing preferably has a flange 40.2 at one end for preventing excessive movement of the latch means into the breaker mounting bushing 34.

Figure 1:
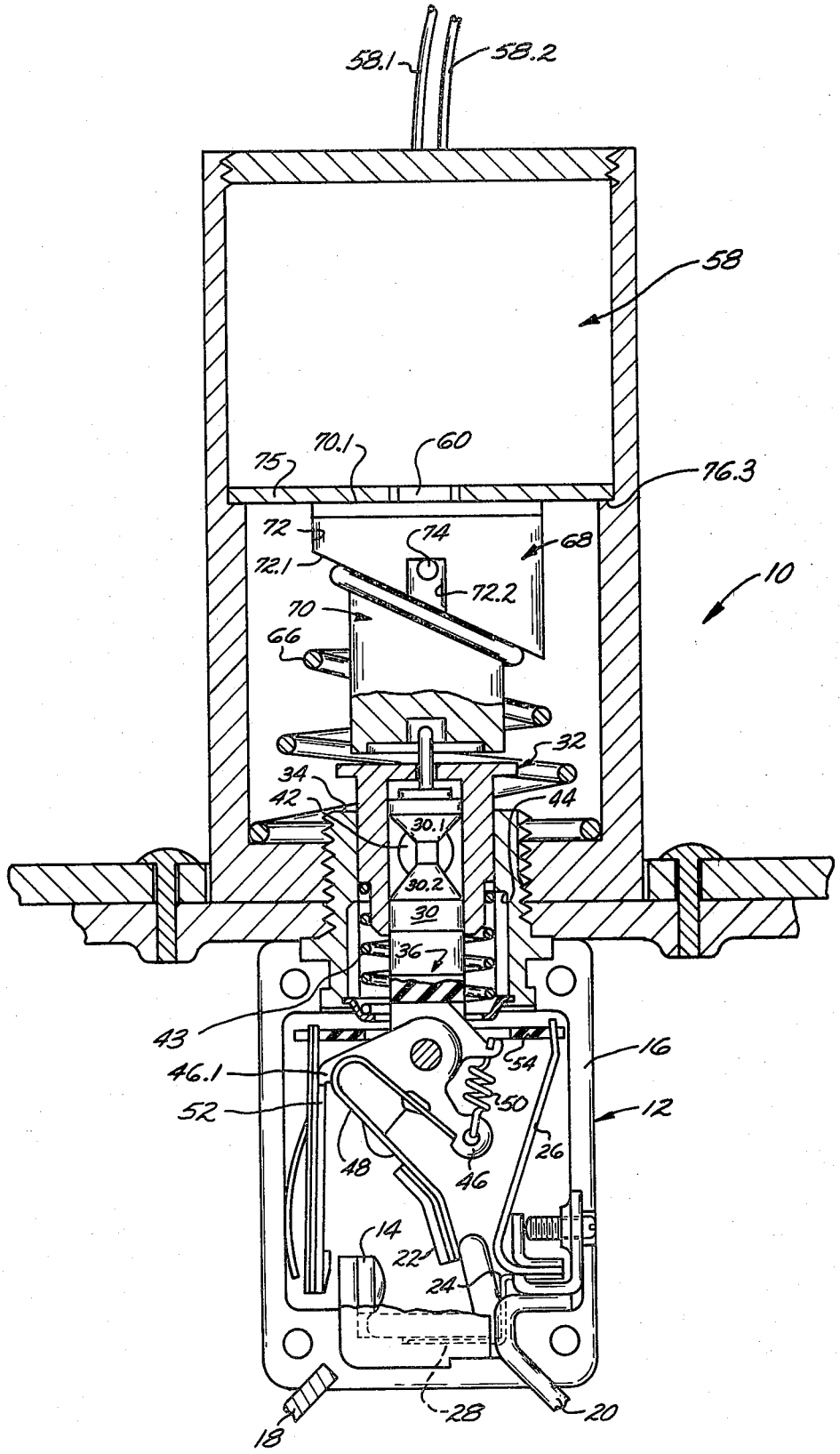
FIG. 1 is a section view along the longitudinal axis of the circuit breaker system of this invention illustrating the circuit breaker in open circuit position.
Figure 2:
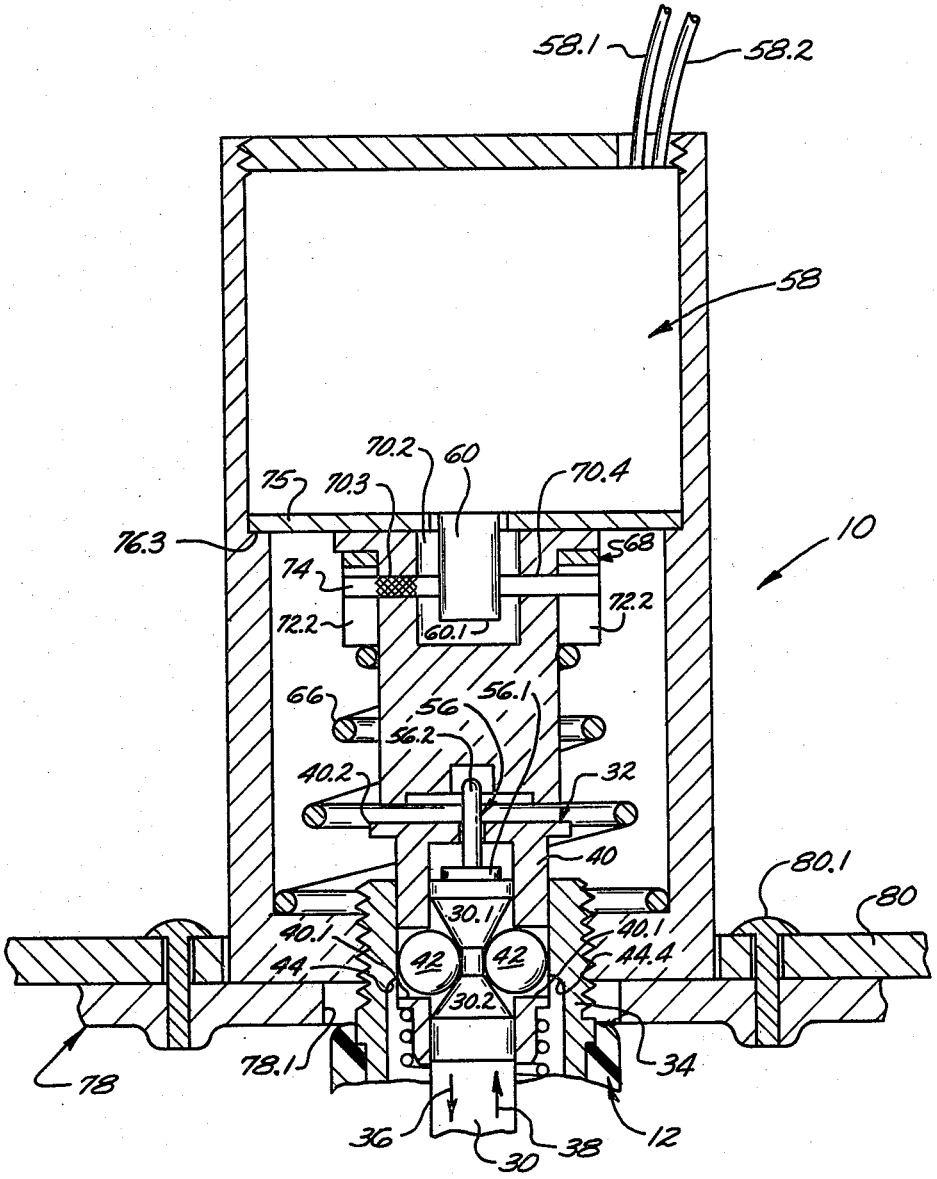
FIG. 2 is a partial section view along line 2—2 of FIG. 1.

A bell crank 46 carrying the bridging contact member 22 on a resilient contact arm 48 is pivotally mounted on the operating member and is resiliently biased by a coil spring 50 to rotate in a counterclockwise direction as viewed in FIGS. 1 and 3. A protrusion 46.1 on the bell crank is adapted to engage an additional latch 52 as is illustrated in the drawings. The bimetallic member 26 is adapted to self-heat and to flex when electrical current is directed through the breaker circuit, and a motion transfer member 54 is arranged to transfer that flexing movement to the additional latch 52 as will be understood.

In that arrangement, movement of the latch means 32 in the direction of the arrow 36 from the open circuit position shown in FIG. 1 moves the operating member 30 in the direction of the arrow 36 into the circuit breaker housing. The bell crank protusion 46.1 normally engages the latch 52 so that the bell crank rotates in a clockwise direction as viewed in FIG. 1 to engage the contact bridging member 22 with the fixed contacts 14 to close the breaker circuit. As the latch means 32 moves in the direction of the arrow 36, the resilience of the contact arm 48 and of the coil spring 50 apply a force to the operating member (as by the arrow 38) and that force is applied to the latching balls 42 through the cam surface 30.2 of the operating member until, as the latch bushing 40 is moved past the cam surface 44 on the threaded mounting bushing 34, that force moves the latching balls out through the latch bushing apertures 40.1 to be engaged under the cam 44, thereby to releasably latch the operating member 30 and the latch means 32 for holding the circuit breaker in the closed contacts position shown in FIG. 3.

If the breaker circuit is subsequently overloaded to a predetermined degree such that the thermally responsive bimetal 26 moves enough to dislodge the additional latch 52 from engagement with the bell crank protusion 46.1, the bell crank immediately rotates in a counterclockwise direction to open the breaker circuit. At that point, movement of the operating member 30 is no longer restrained by engagement of the crank protusion 46.1 and the member moves a short distance further in the direction of the arrow 36 into the circuit breaker housing. That movement removes the camming force applied to the latching balls 42 by the cam surface 30.2. Accordingly, the balls are cammed back into the latch bushing 40 by action of the cam surface 44 on the mounting bushing. In that way, the operating member is unlatched and the member moves in a direction of the arrow 38 to the open circuit position shown in FIG. 1 under the bias of the spring 43.

Alternately, if the circuit breaker 12 is in the closed circuit position as shown in FIG. 3, the circuit breaker is also adapted to be selectively opened by means of the actuating pin 56 which is moveably mounted in the latch bushing aperture 40.3. That is, the head 56.1 of the actuating pin is entrapped inside the bushing so that the pin shaft 56.2 extends outside the bushing to be moveable for selectively moving the operating member 30 in the direction of the arrow 36. In that way, movement of the actuating pin in the direction of the arrow 36 moves the operating member independently of the latch bushing 40 and balls 42 to release the force applied to the latching balls, whereby the cam 44 forces the balls back into the latch bushing for again unlatching the operating member and allowing it to open the breaker circuit. As the circuit breaker as above described is of generally conventional configuration as shown in U.S. Pat. No. 3,361,882, it is not further described in here and it will be understood that the breaker has latch means which are moveable in a first direction to move an operating member from a first circuit position to a second circuit position to be latched in that second position, has the operating member arranged in said second circuit position to be independently moveable in that same first direction for unlatching the operating member to permit it to return to the first circuit position, and also has means responsive to the occurence of selective overload conditions in the breaker circuit for automatically unlatching the operating member to permit it to return to said first circuit position.

Figure 6:
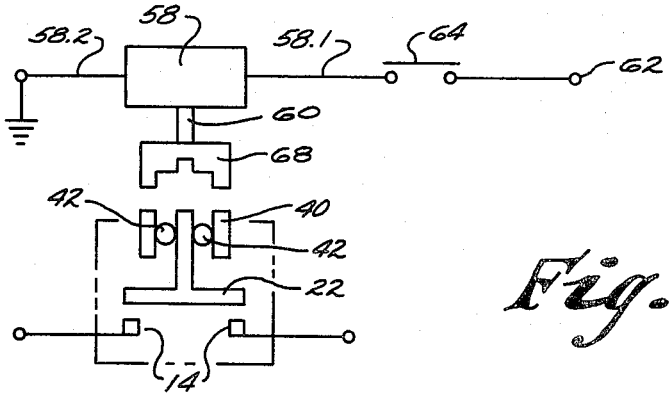
FIG. 6 is a schematic view diagrammatically illustrating remote operation of the system of FIG. 1.

In accordance with this invention, the system 10 further includes solenoid means 58 or the like having a plunger 60, the solenoid means being operable from a remote location for moving the plunger from a rest position to an extended position and for thereafter permitting return of the plunger to its rest position. In a preferred embodiment, for example, the solenoid means is of any conventional type having coil leads 58.1, 58.2 electrically connected to a power source 62 through any conventional, momentarily-operable switch 64 as is diagrammatically illustrated in FIG. 6. Closing of the switch 64 is adapted to energize the solenoid and move the plunger from the rest position shown in FIGS. 1, 2 and 4 to the extended or actuating position shown in FIGS. 3 and 5. The system also has spring means 66 for biasing the plunger to return to its rest position after such momentary operation of the solenoid is completed. Typically, low cost solenoid means 58 are employed and the momentarily operable switch 64 is selected so that any manual operation of the switch is adapted to apply an energizing electrical pulse of about 20 to 50 milliseconds duration to the solenoid means. In that way, plunger movement is effective for fully extending the solenoid plunger to assure latching or unlatching of the circuit breaker 12 and for then permitting the plunger to return to its rest position without tending to overheat the solenoid means.

In accordance with this invention, pawl means 68 are pivotably mounted on the solenoid plunger and are biased to move from one pawl position to a second pawl position. Preferably for example, the pawl means comprises a central bushing 70 having a flat surface 70.1 at one end. A tapered sleeve 72 is fitted over the central bushing and has a surface 72.1 which is disposed obliquely relative to the end surface 70.1. A large bore 70.2 is formed in the bushing for freely receiving one end 60.1 of the solenoid plunger, and slots 72.2 are formed on opposite sides of the tapered sleeve. A mounting pin 74 is then fitted into openings 70.3, 70.4 and 60.2 in the bushing and plunger, the pin having a knurled part press-fitted into the opening 70.4 for securing the pin to the bushing. In that arrangement, the pawl means is pivotably mounted on the plunger. The opposite end 70.5 of the central pawl bushing has a first, outer, actuating surface portion 70.6, has a second, inner, recessed actuating surface portion 70.7, and has a central clearance recess 70.8. Preferably a washer 75 is fitted over the solenoid plunger before the pawl means 68 are pivotably mounted on the plunger.

In a preferred embodiment of the invention, a housing sleeve 76 is provided with a threaded bore 76.1 at one end and with a relatively larger diameter threaded bore 76.2 at its opposite end. A flange piece 78 having a central opening 78.1 and mounting taps 78.2 is fitted over the threaded mounting bushing 34 of the circuit breaker 12. The housing sleeve 76 is then threaded on to the breaker mounting bushing for securing the flange and the sleeve housing to the breaker. The flange 78 then serves to mount to circuit breaker system 10 on a suitable support 80 with screws 80.1 as will be understood. The sleeve housing is preferably provided with a step or shoulder 76.3. The coil spring 66 is then fitted into the housing sleeve and the solenoid means 58 is fitted into the larger diameter end of the sleeve to rest on the washer 75 on a shoulder 76.3 as shown in the drawings. A cover 77 is threaded into the bore 76.2.

Figure 4:
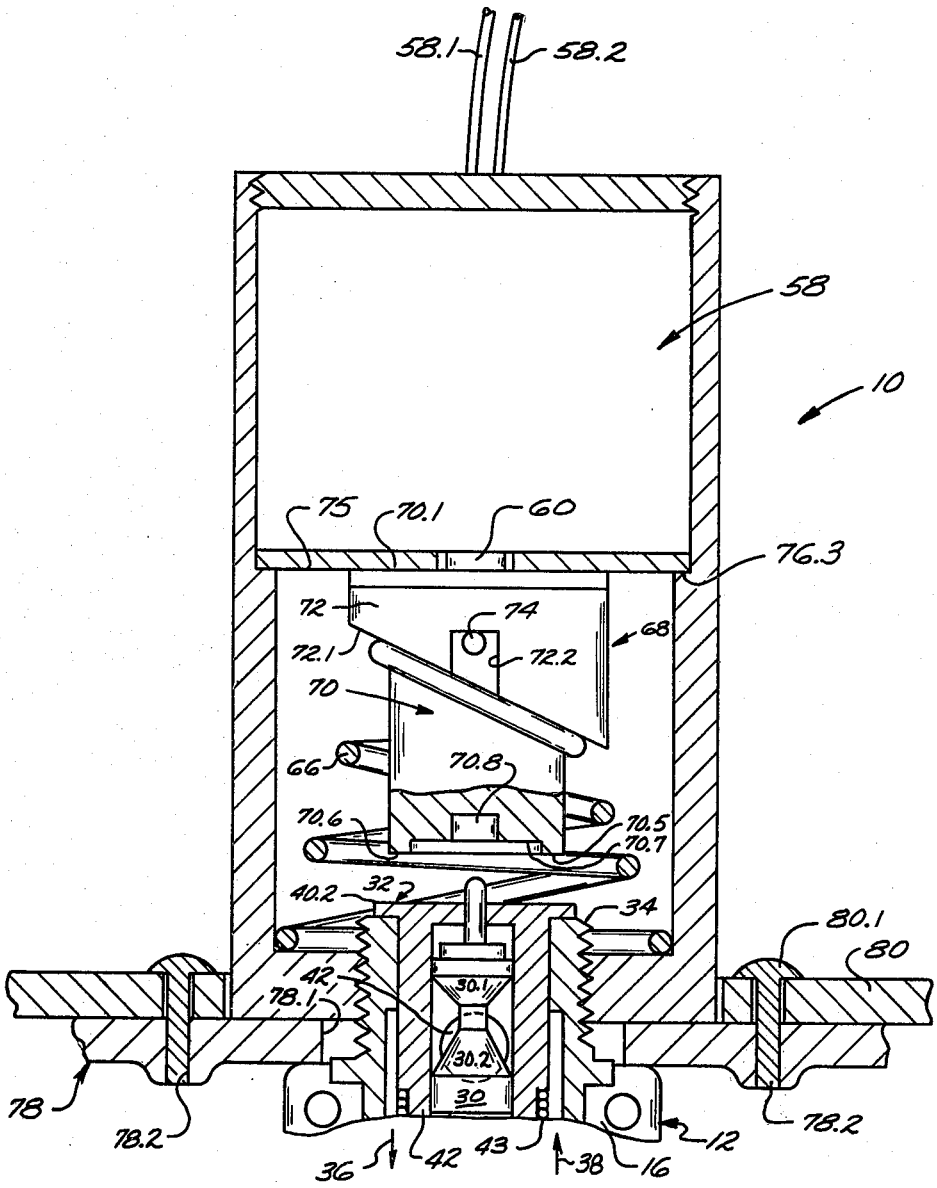
FIG. 4 is a partial section view similar to FIG. 3 illustrating the circuit breaker in closed circuit position with the solenoid means of the system in rest position.
Figure 5:
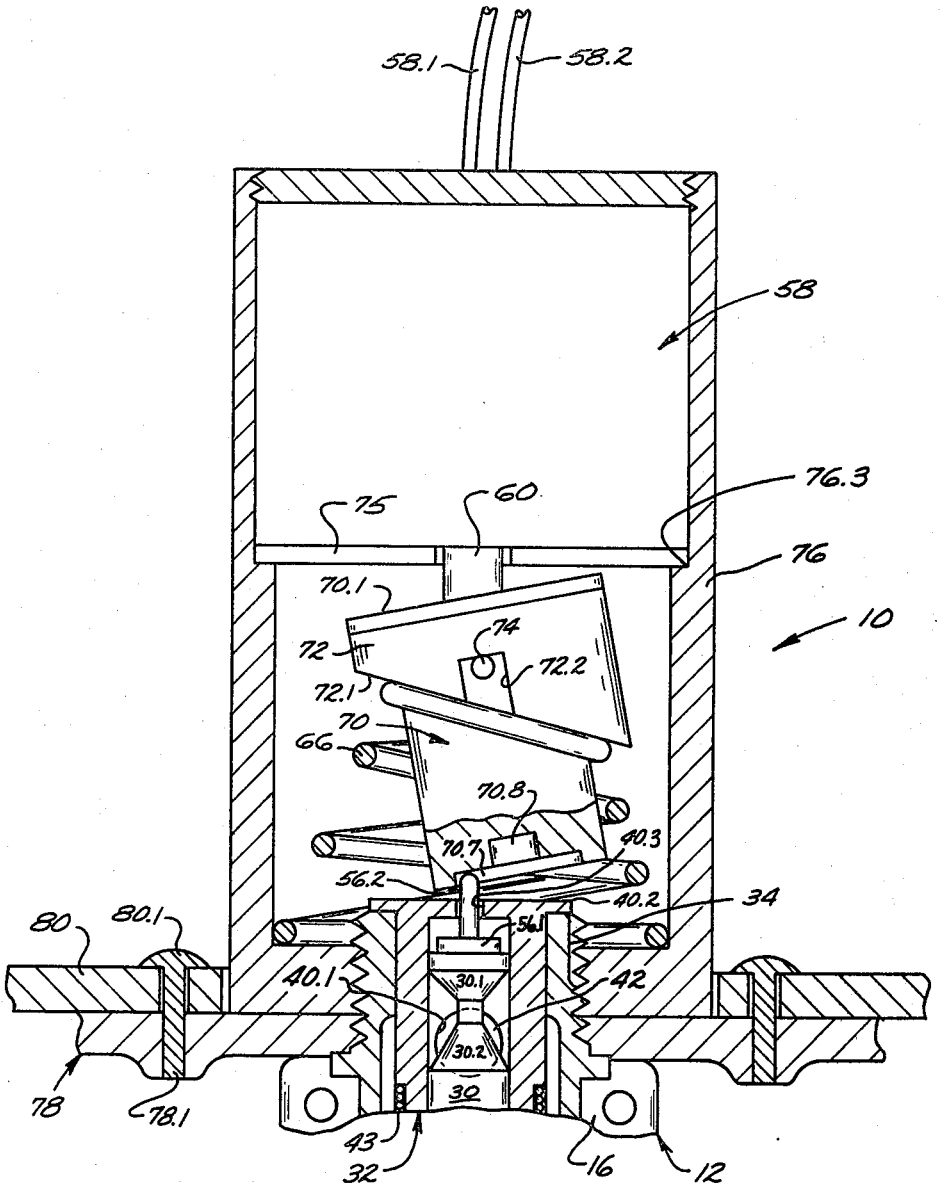
FIG. 5 is a partial section view similar to FIG. 4 illustrating remote operation of the system for selectively opening the breaker circuit.

In that way, when the circuit breaker component 12 is in its open circuit position as shown in FIG. 1, the coil spring 66 engages the tapered sleeve surface 72.1 and biases the pawl means 68 in the direction indicated by the arrow 38 so that the end surface 70.1 of the pawl bushing resiliently bears against the stop means formed by the washer 75. Alternately, if the washer is omitted, the end surface 68.1 resiliently bears directly against the solenoid means 58. The engagement of the pawl end 70.1 with the stop means holds the pawl means in a first orientation on the plunger 60 as shown in FIG. 1 so that the first actuating portion 70.6 of the pawl means is aligned with the latch means 32 in the circuit breaker 12. Accordingly, when the solenoid means 58 are momentarily actuated for moving the plunger 60 in the first direction indicated by arrow 36 from its rest position to its extended position against the bias of the spring 66, the solenoid moves the operating member of the circuit breaker to its closed circuit position and latches the circuit breaker in said closed circuit position as shown in FIG. 3. The solenoid plunger is then resiliently biased back to its rest position by the spring 66 and, as the end 70.1 of the pawl means re-engages the stop means 75, again orients the pawl means in their first orientation as shown in FIG. 4. Accordingly, if the breaker circuit should open automatically in response to the occurence of an overload condition or the like in the circuit, the circuit breaker latch means and the operating member return to the position shown in FIG. 1. The first actuating portion of the pawl means is therefore again aligned with the latch means 32 and the breaker circuit is therefore adapted to be reclosed by re-energizing of the solenoid.

However, if the circuit breaker is in the closed contacts position shown in FIG. 4 and selective opening of the breaker is desired, momentary operation of the solenoid is again effected by closing of the switch 64. In that way, the solenoid plunger is moved toward its extended position and, as the pawl end 70.1 moves away from the stop means 75, the pawl means is rotated or pivoted to a second orientation on the solenoid plunger by resilient biasing of the spring 66 against the tapered sleeve surface 72.1. In that way, the second actuating portion 70.7 of the pawl means is aligned with the actuating pin 56 of the operating member for moving the operating member in the same, first direction indicated by the arrow 36, thereby to unlatch the circuit breaker as above described. Accordingly, as the pawl means are subsequently returned to the position shown in FIG. 1, the latch means and operating member of the circuit breaker are also returned to the position shown in FIG. 1. Thus, the system is again set for selective reclosing of the circuit breaker.

In that way, the circuit breaker system 10 is of low cost, versatile construction and is adapted to utilize circuit breaker components of various conventional types. The system is adapted for reliable, remotely-controlled operation and is economically adapted to serve protecter and contacter functions as above described. Various modifications of the disclosed embodiments are possible. For example, the solenoid housing could be adapted for threaded mounting in a supporting panel without one of the mounting flange previously described. It should be understood that although particular embodiments of this invention have been described above by way of illustrating the invention, the invention includes all modifications and equivalence of the described embodiments falling within the scope of the appended claims.

I claim:

1. In a system having latch means moveable in a first direction to move a member from a first position to be latched in a second position and having the member arranged in said second position to be independently moveable in said first direction for unlatching the member to return to said first position, remote control means having a plunger, the remote control means being operable from a remote location for moving the plunger, pawl means pivotedly mounted on the plunger, and means biasing the pawl means for pivotal movement, the pawl means being normally disposed so that operation of the control means to move the plunger when the member is in said first position engages the pawl means with the latch means for moving the member in said first direction to be latched in said second position and so that operation of the control means to move the plunger when the member is in said second position permits the pawl means to rotate in response to said biasing means to engage the member and move the member in said first direction for unlatching the member to return to said first position.

2. A remotely controlled circuit breaker system comprising a circuit breaker having latch means moveable in a first direction to move an operating member from a first circuit position to a second circuit position to be latched in said second circuit position and having the operating member arranged when in the second circuit position to be independently moveable in said first direction for unlatching the member to return to the first circuit position, solenoid means having a plunger operable from a remote location for moving the plunger, pawl means pivotably mounted on the plunger, stop means, and means biasing the pawl means for pivotable movement, the pawl means being normally disposed against the stop means in a selected position relative to the latch means so that operation of the solenoid means to move the plunger when the operating member is in the first circuit position engages the pawl means with latch means for moving the operating member in said first direction to be latched in said second circuit position and so that operation of the solenoid means to move the plunger when the operating member is in the second circuit position moves the pawl means away from the stop means to rotate in response to said biasing means to engage and move the operating member in said first direction for unlatching the operating member to return to the first circuit position.

3. A remotely controlled circuit breaker system as set forth in claim 2 wherein the pawl means are resiliently biased against the stop means to be normally disposed in said selected position relative to the latch means.

4. A remotely controlled circuit breaker system as set forth in claim 3 wherein the means biasing the pawl for pivotable movement resiliently bias the pawl means against the stop means.

5. A remotely controlled circuit breaker system comprising a circuit breaker having latch means moveable in a first direction to move an operating member from open to closed circuit position to be releasably latched in closed circuit position, having the operating member arranged when in said closed circuit position to be independently moveable in said first direction for unlatching the operating member to permit it to return to open circuit position, and having means responsive to conditions in the circuit for automatically unlatching the operating member to return to open circuit position, solenoid means having a plunger, stop means, and pawl means pivotably mounted on the plunger, the solenoid means being momentarily operable from a remote location for moving the plunger from a rest position to an actuating position, and spring means biasing the pawl means against the stop means to resiliently hold the plunger in its rest position in a selected location relative to the latch means so that momentary operation of the solenoid means when the operating member is in open circuit position engages the pawl means with the latch means for moving the operating member to closed circuit position against said bias to be latched in closed circuit position and then returns the pawl means back against the stop means, the spring means also biasing the pawl means for pivotal movement on the plunger so that momentary operation of the solenoid means when the operating member is in closed circuit position moves the pawl means away from the stop means and rotates the pawl means in response to said bias to engage and move the operating member in said first direction for unlatching the operating member to move to open circuit position.

6. A remotely controlled circuit breaker system as set forth in claim 5 wherein the pawl means has first and second obliquely disposed surfaces and a spring means bears against one of the surfaces for resiliently holding the other surface against the stop means when the plunger is in its rest position to orient the pawl means in said selected location to engage the latch means when the operating member is in open circuit position, the spring means rotating the pawl means when the plunger is moved while the operating member is in closed circuit position to reorient the pawl means to engage the operating member.

7. A remotely controlled circuit breaker system as set forth in claim 6 wherein the latch means and operating member are coaxially mounted for movement between said open and closed circuit positions and the plunger is adapted to move coaxially with the latch means and operating member.

8. A remotely controlled circuit breaker system as set forth in claim 7 wherein the circuit breaker has an externally threaded bushing mounting the latch means and operating member for movement within the bushing, the solenoid means has a housing and has the plunger mounted for axial movement in the housing, the housing is threadedly engaged with the bushing to mount the solenoid plunger for coaxial movement with the latch means and operating member.

9. A remotely controlled circuit breaker system as set forth in claim 8 wherein a mounting flange has an aperture fitted over the bushing and the threaded engagement of the solenoid housing with the circuit breaker mounting bushing secures the flange to the circuit breaker.

* * * * *